United States Patent [19]

McCarty

[11] 4,136,529

[45] Jan. 30, 1979

[54] AIR CONDITIONING APPARATUS

[75] Inventor: William J. McCarty, Louisville, Ky.

[73] Assignee: General Electric Company, Louisville, Ky.

[21] Appl. No.: 839,134

[22] Filed: Oct. 3, 1977

[51] Int. Cl.[2] ..... F25B 47/00; F28D 5/00; F24F 3/14

[52] U.S. Cl. ..... 62/280; 62/305; 165/60

[58] Field of Search ..... 62/279, 280, 324, 91, 62/304, 305; 165/60

[56] References Cited

U.S. PATENT DOCUMENTS

| | | | |
|---|---|---|---|
| 2,654,232 | 10/1953 | Galazzi | 62/91 |
| 2,672,024 | 3/1954 | McGrath | 62/305 |
| 2,777,303 | 1/1957 | Slattery | 62/150 |
| 2,797,560 | 7/1957 | Kooiker et al. | 62/280 |
| 2,911,797 | 11/1959 | Stocking | 62/176 R |
| 2,982,110 | 5/1961 | Kramer | 62/280 |
| 3,079,767 | 3/1963 | Speaker | 62/280 |
| 3,152,454 | 10/1964 | Eberhart | 62/150 |
| 3,938,352 | 2/1976 | Schmidt | 62/305 |

*Primary Examiner*—Lloyd L. King
*Attorney, Agent, or Firm*—Frank P. Giacalone

[57] ABSTRACT

In a self-contained air conditioner unit of the reversible type having cooling and heating cycles, a no-drain heat pump is provided wherein in the cooling cycle condensate water collected on the indoor heat exchanger operating as an evaporator is transferred to the outdoor section of the unit where it is atomized and directed through the relatively warm outdoor heat exchanger operating as a condenser. In the heating cycle, water collected on the outdoor heat exchanger operating as an evaporator during heating is transferred to the indoor section. The condensate is directed into the air flow circulating through the indoor section where it atomizes and passes through the relatively warm indoor heat exchanger to humidify the air.

10 Claims, 3 Drawing Figures

AIR CONDITIONING APPARATUS

BACKGROUND OF THE INVENTION

Conditioning the air within an enclosure has been accomplished by a self-contained unit employing a refrigeration cycle with the unit generally located within an opening in the enclosure. In order to both heat and cool the air within the enclosure, the reversible type of refrigeration apparatus has been used containing two heat exchangers, one located within the enclosure and the other outside the enclosure exposed to the outdoor air. These heat exchangers operate interchangeably as a condenser and an evaporator to both heat and cool the enclosure. Control means are provided by which reversal of the operating cycle can be obtained. The apparatus provided with a sump located beneath the outside coil. Troughs in the base pan conduct condensate dropping from the inside coil to this sump. Condensate removal means are provided for directing the condensate onto the condenser, cooling it and disposing of the condensate by evaporation. Condensate from the outdoor coil collects in this sump when the outdoor heat exchanger is operating as an evaporator on the heating cycle; accordingly, none of this water is disposed of by evaporation and builds up as it is splashed over the outdoor coil by the condensate removal means. The apparatus may also at times have to operate on the heating cycle when a below-freezing outside temperature has frozen this sump water, locking the fan rigid. This usually results in blown fuses or damaged parts when the apparatus is operated.

Some prior art attempts have provided drains in the condensate sump such as disclosed in U.S. Pat. No. 2,777,303-Slattery, assigned to the General Electric Company, the assignee of the present invention. The patent teaches the use of a thermally responsive element that cooperatively opens the sump drain when the outside temperature falls below a predetermined temperature to drain the sump of any condensate that may have collected. U.S. Pat. No. 3,152,454—Eberhart also teaches providing a temperature responsive valve means that is actuated when the temperature falls below a predetermined temperature for draining condensate from the sump.

U.S. Pat. No. 2,982,110—Kramer discloses an apparatus that selectively conducts condensate formed at the outdoor heat exchanger to the vicinity of the indoor heat exchanger during the heating cycle and in accordance with predetermined humidity condition in the vicinity of the latter heat exchanger, and treats the circulating air being heated by entraining the condensate therein.

SUMMARY OF THE INVENTION

The present invention relates to a self-contained air conditioning unit for heating and cooling and includes a casing mounted in an aperture in the wall of an enclosure to be conditioned. Arranged in the casing is a chassis including a base portion and a barrier dividing the chassis into an indoor and an outdoor compartment. Mounted in the inner compartment is an indoor heat exchanger and a fan for recirculating enclosure air through the indoor compartment. Mounted in the outdoor compartment is an outdoor heat exchanger, a fan for circulating air through the outer compartment, the system compressor, and a reversing valve for selectively connecting the compressor to the heat exchangers whereby the outdoor heat exchanger functions as an evaporator during the heating cycle and the indoor heat exchanger functions as the evaporator during the cooling cycle.

In the heating cycle water collected on the outdoor heat exchanger functioning as an evaporator during heating passes through a sump drain in the outdoor compartment and into a collecting chamber arranged below the drain and a portion of the indoor chamber. The water is lifted out of the collecting chamber and directed into the air flow circulating through the indoor section where it atomizes and passed through the relatively warm indoor heat exchanger functioning as a condenser to humidify the air.

DESCRIPTION OF THE PREFERRED EMBODIMENT

Figure 1:
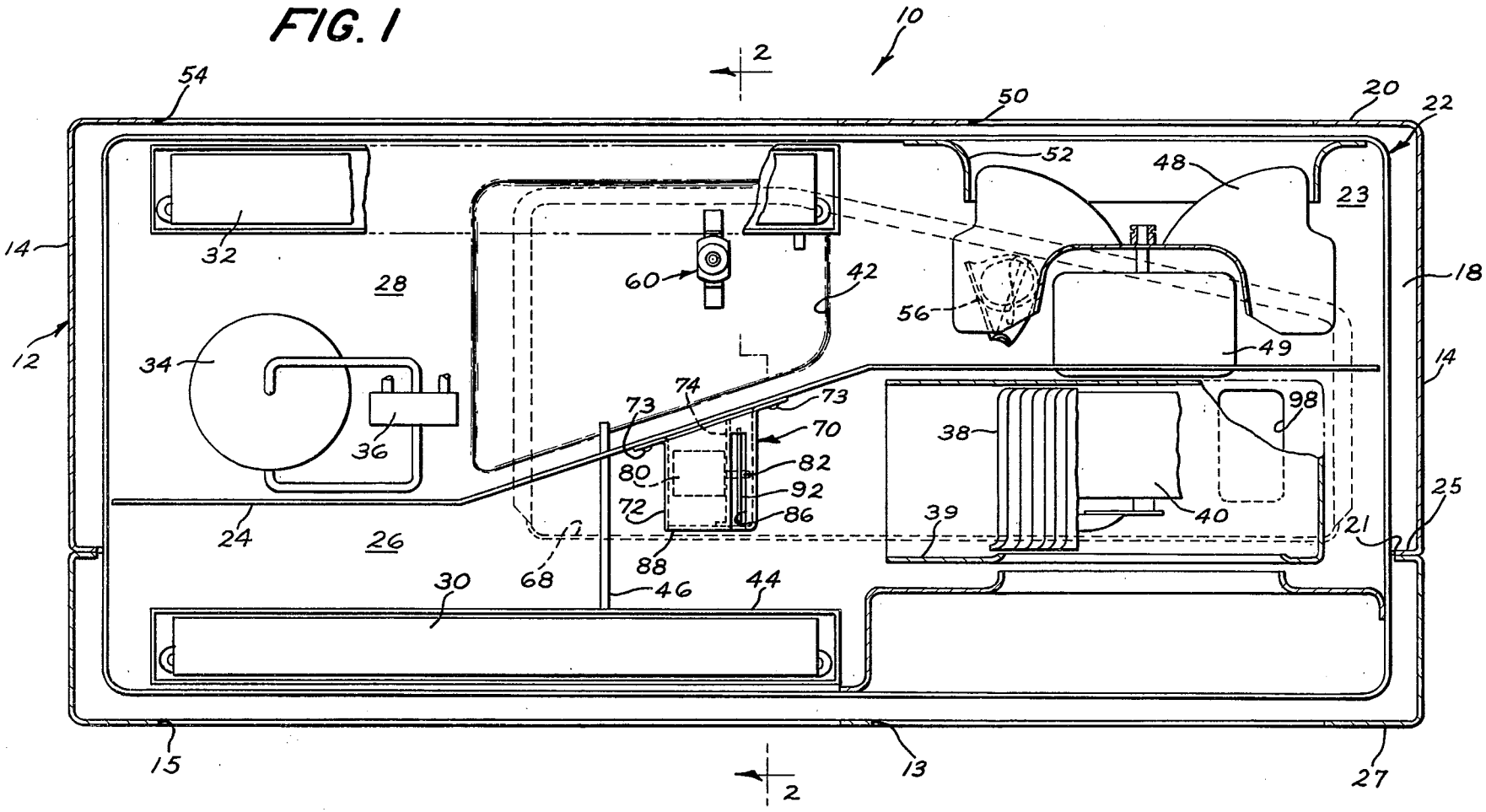
FIG. 1 is a plan view partially in section of an air conditioning unit incorporating the present invention.

Referring now to the drawings and initially to FIG. 1 thereof, there is illustrated an air conditioner unit 10 which is arranged to be positioned within an opening in an enclosure. The unit includes a casing or outer wall sleeve 12 arranged in a wall opening. The sleeve 12 includes side walls, top wall, bottom wall, and rear walls 14, 16, 18, and 20, respectively defining a front opening 21 disposed in the enclosure to be conditioned. A chassis unit 22 including the refrigeration system and components of the unit is arranged in the sleeve 12 through opening 21. The opening 21 is further defined by a frame or flange 25 on which is supported a front grille assembly 27 having an inlet 13 and an outlet 15.

The air conditioning unit is of the reversible flow type and the chassis 22 includes a base 23 that is divided by a partition or barrier 24 into an inner compartment 26 and an outer compartment 28 in which there are mounted respectively an indoor heat exchanger 30 and an outdoor heat exchanger 32. The heat exchangers 30 and 32 are connected in refrigerant flow relationship with a compressor 34, also positioned in the outer compartment 28. In the illustrated embodiment of the invention the refrigeration system is provided with a reversing valve 36 which may be selectively operated to reverse the flow of refrigerant to the heat exchanger units 30 and 32 in order to heat or cool the respective air streams circulated over these heat exchangers.

When the conditioner is in operation, air is drawn from within the room through inlet 13 and recirculated by an air moving means or blower wheel 38 arranged in a scroll 39. The room air is directed through the inner compartment 26 of the unit, passed through the heat exchanger 30 and outlet 15. The blower 38 is driven by a motor 40 mounted in the barrier 24. During operation of the unit on the cooling cycle, the heat exchanger 30 is operated as an evaporator and moisture from the air stream being circulated over heat exchanger 30 is condensed onto its coil surfaces. Means are provided for collecting this condensate water and delivering it to a water receptacle or condensate collection sump area 42 formed in the base 23 of chassis 22 in the outer compartment 28. More specifically, these means include a suitable drip tray 44 (seen best in FIG. 1) from which condensate water is delivered to the sump 42 through means of a conduit 46. When the air conditioning unit is operated on the cooling cycle, the outdoor heat exchanger 32 is operated as a condenser and is cooled by the outdoor air being circulated thereover by a fan 48 driven by a motor 49 mounted on barrier 24. When the unit is operating on the heating cycle, the reversing valve 36 is actuated to reverse the flow of refrigerant to the heat exchangers 30 and 32, thereupon utilizing the indoor heat exchanger 30 as a condenser and the outdoor heat exchanger 32 as an evaporator. The heat exchanger 32 now operating as an evaporator condenses moisture out of the outside air. Condensate water drips from the outdoor heat exchanger 32 into the bottom of the outer compartment and is thereby delivered to condensate collection sump 42 formed in the base 23 of the outer compartment 28. As will be explained in detail hereinafter it is this water collected in sump 42 from heat exchanger 32 that is transferred to the indoor compartment and added to the recirculating indoor air.

It is to be noted that sump 42 may take on any desirable form and is, of course, not limited to the arrangement wherein the water receptacle or sump 42 forms the entire bottom portion of base 23 in the outer compartment of the chassis 22. In the cooling cycle water collected in sump 42 from indoor heat exchanger 30 is disposed in the following manner in the embodiment shown. Air moving means 48 for circulating air through the outer compartment 28 is disposed so that it circulates at least a portion of the air stream in a direction substantially parallel with and over the surface of the water in sump 42. More specifically, the air fan 48 draws air inwardly through an inlet opening 50 and the orifice opening 52 against the barrier 24 and is diverted radially by the fan 48 and barrier 24 into the remaining portions of the outer compartment 28.

In the embodiment of the invention shown, the fan 48 is a mixed-flow fan in which the air is propelled rearwardly by the forward portions of the fan blades and turned within the fan to be propelled in a direction normal to the axis of the fan. As may best be seen in FIG. 1, the mixed-flow fan 48 circulates a stream of air along the surface of the water in the sump 42 and this air stream, as will hereinafter be described, aids in the entrainment of water droplets from the sump 42 into the air stream flowing through the outer compartment. The air stream flows through the remaining portions of the outer compartment 24, over the heat exchanger 32, and then discharged to the outdoors through an outlet opening 54. It should be noted that, while a mixed-flow fan creates a great deal of radial air flow, this is also true of the normal axial flow fan and such fan could easily be used as long as a portion of the air stream discharging therefrom passes over the surface of the condensate sump 42.

In order to aid in disposing of condensate water collecting in sump 42, an air vortex generator 56 of the type fully explained in U.S. Pat. No. 3,079,767, assigned to the General Electric Company, assignee of the present invention, may be used. The vortex generator is designed to receive or trap a portion of the air stream circulating through the outer compartment and impart a swirling motion, as well as a thrust, to this swirling air mass in an angular direction with respect to the original direction of air flow, thereby creating a relatively stable air vortex discharging from the generator.

As mentioned hereinbefore, the present invention provides means in the heating cycle to employ the condensate collected in the sump area 42 for adding moisture to the indoor air being recirculated by the blower 38.

Figure 2:
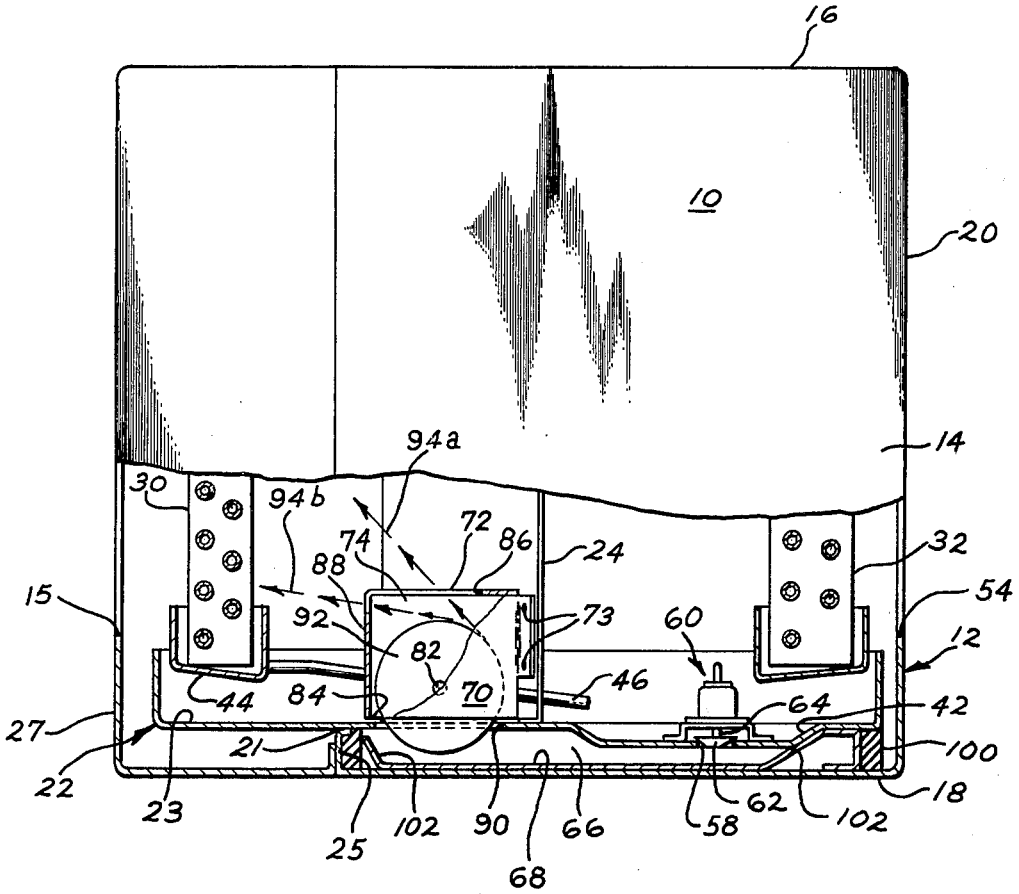
FIG. 2 is a partial side elevational view taken along line 2—2 of FIG. 1.

The means for transferring the condensate water from sump 42 to the interior chamber of the air conditioning unit where it may be added to the interior air is best shown in FIGS. 1 and 2.

Positioned in substantially the lowest point or bottom of the sump 42 is a drain opening 58 which is open and closed by a temperature controlled automatic valve assembly 60. This assembly has its valve member 62 in the normally closed position during the cooling cycle of the unit. The valve may be designed to open automatically whenever the outdoor temperature falls below a predetermined temperature, or, alternatively, when the unit is placed in the heating cycle. The valve assembly 60 has its sealing or valve member 62 mounted on a movable valve stem 64 that seals the drain 58 in its closed position. In operation, when the outdoor temperature falls below the predetermined temperature, the valve member 62 of the temperature controlled valve assembly 60 is raised, allowing any condensate water present in sump 42 to pass through the open drain 58. Further with the unit in the heating cycle and the outdoor heat exchanger 32 functioning as an evaporator, condensate collected therein will continually flow through open drain 58 into the tray 68. The condensate so drained from sump 42 is directed into a collecting chamber 66 arranged between the casing 12 and the base 23 of chassis 22. Arranged on the bottom wall 18 of the casing 12 in the chamber 66 is a lower condensate collector pan or tray 68 which, as best seen in FIGS. 1 and 2, underlies a portion of sump 42 under the drain 58 and extends to a position beneath the indoor chamber 26, including a portion lying beneath the indoor blower 38. When the draining of sump 42 is based on outdoor ambient, the temperture at which valve member 62 opens drain 58 to evacuate sump 42 has been selected to be 65° F. or lower on the basis that it would be unlikely that cooling would be required at or below 65° F., and accordingly no further condensate would be directed into sump 42 from the indoor heat exchanger 30 due to operation of the unit in the cooling cycle.

It should be understood, as mentioned hereinbefore, that other alternative ways may be employed for closing the opening of drain 58. The drain can be opened each time the unit is placed in its heating cycle and remains open during operation of the unit in the heating cycle independent of outdoor temperature.

Figure 3:
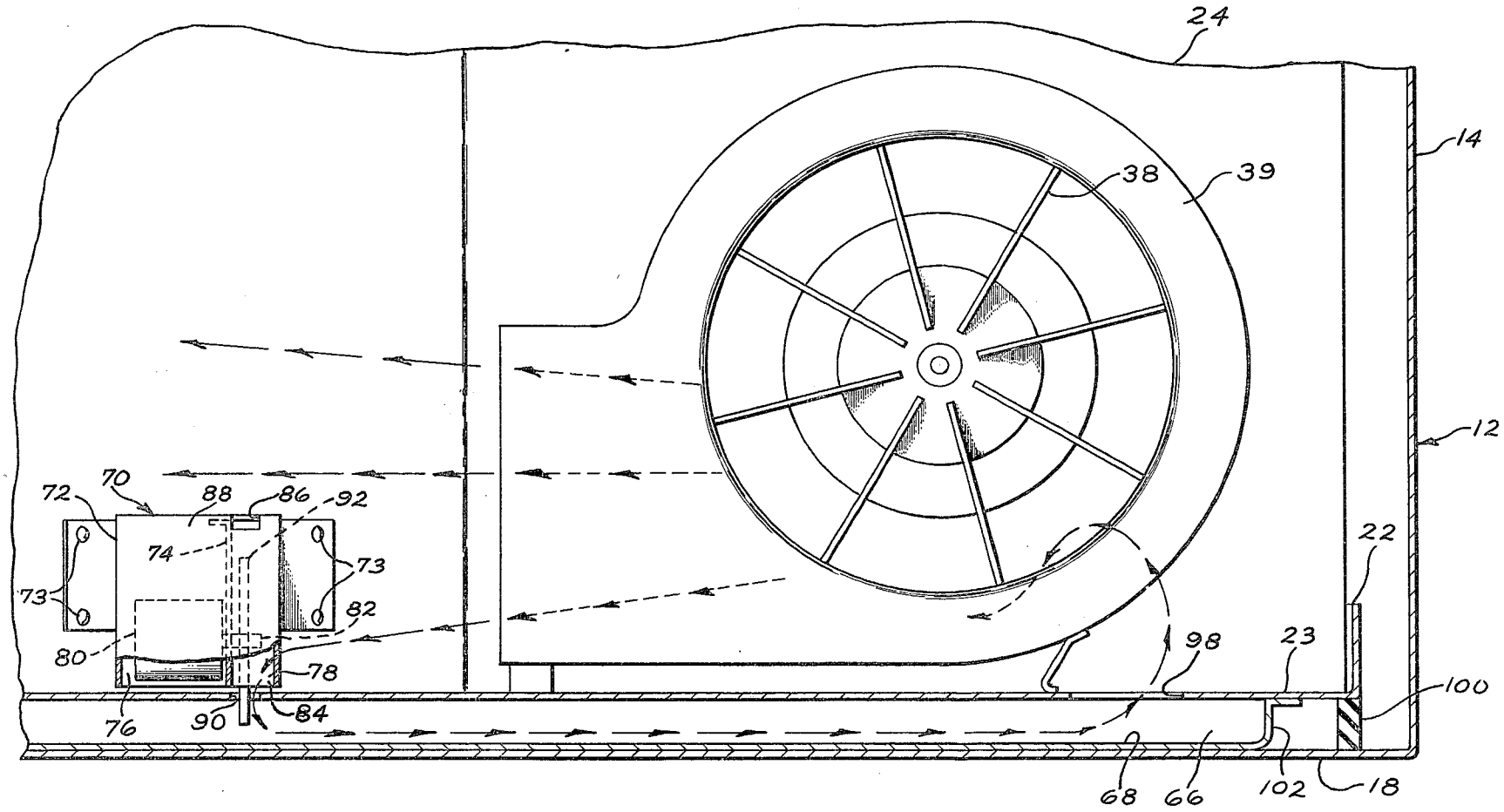
FIG. 3 is a partial front elevational view taken along line 3—3 of FIG. 1 showing details of the present invention.

In carrying out the humidification of the indoor air, means are provided for transferring the condensate so collected in tray 68 into the air stream being recirculated by blower 38 through the enclosure being conditioned. The means for transferring the condensate into the air stream includes a slinger mechanism 70 arranged in the indoor chamber 26 between the partition 24 and the heat exchanger 30. As best seen in FIG. 3, the slinger mechanism 70 includes a housing 72 which is mounted on the partition 24 adjacent the base 23 of chassis 22 by a suitable fastening means 73. The housing is divided by a wall 74 into a chamber 76 and a passageway 78. A motor 80 is mounted in the chamber 76 with its substantially horizontally arranged shaft 82 (FIG. 2) extending through the wall 74 and into the passageway 78. The bottom portion of the housing 72 adjacent the base 23 is provided with an opening 84 into the passageway 78.

A slot 86 communicating with passageway 78 is provided on the top wall of the housing. The slot 86 extends downwardly into the upper portion of the wall 88 facing the heat exchanger 30. The opening 84 at the bottom of passageway 78 is in communication with an opening 90 in the base 23. The opening 90 is arranged over a portion of the collection tray 68 so that a path for condensate water is provided from tray 68 through openings 90, 84, passageway 78, and slot 96 into the inner compartment 26.

The means for lifting the condensate water from the tray 68 includes a slinger disc 92 mounted on the portion of the shaft 82 that is arranged in passageway 78. As best seen in FIG. 2, the disc 92 is dimensioned so that its lower portion extends through openings 84, 90 and into the collection chamber, and more specifically the lower circumferentially disposed edge of disc 92 is positioned in the tray 68.

The slinger mechanism 70 is installed or mounted on the partition 24 during the manufacturing and assembly operation of the chassis 22, and as shown in FIG. 2 the lower portion of the slinger disc 92 extends through opening 90 in the base 23. Accordingly, in the process of inserting chassis 22 into the casing 12, the lower portion of the disc 92 extending below the base 23 engages the frame edge portion 25 of the casing 12. Means are provided for allowing the lower portion of disc 92 to pass over the edge portion 25 so that it may be properly positioned in the tray 68 arranged in the bottom wall 18 of casing 12. To this end, the disc 92 is fabricated from a resilient material such as neoprene that has sufficient flexibility over a wide range of temperatures to allow the disc 92 to flex or bend when it engages the edge portion 25 during insertion of chassis 22 with casing 12 so that it will pass over it in its flexed position and then restore itself or snap back to its design configuration after it is past the edge portion 25 so that the plane defined by the surface of the disc is once again perpendicular with the axis of the shaft 82.

In operation, during the heating cycle the slinger disc 92 driven by motor 80, picks up the condensate water from tray 68 and spins it or throws it upwardly through slot 86 in a pattern extending substantially as indicated between the dotted lines 94*a* and 94*b* in FIG. 2 into the flow of air drawn by the indoor blower 38 where it is vaporized and forced through the relatively warm indoor heat exchanger 30 operating as a condenser.

The heat of condenser 30 in the heating cycle is effective to evaporate the moisture as it contacts and passes through the heat exchanger 30 whereupon the vapor and any remaining moisture flows with the recirculating air into the room being conditioned. This entrainment of moisture continues so long as the level of condensate water in tray 68 is at or above the lower peripheral edge of disc 92.

With the condensate collector chamber 66 and its tray 68 arranged outside of the chassis 22 it is subjected to the outside air which may be below freezing during certain operating times of the unit. Accordingly, means are also provided by the present invention to prevent freezing of the condensate water when present in the tray 68. Referring now to FIGS. 1 and 3, there is formed in the indoor portion of the base 23 over the tray 68 an opening 98 arranged to communicate with the upstream air flow of blower 38. The opening 90 arranged or located in the indoor compartment 26 is on the high pressure area relative to the indoor blower 38, while opening 98 arranged on the inlet side of the blower wheel scroll 39 is in the low pressure area. Accordingly, a portion of the relatively warm indoor air being circulated through the indoor compartment 26 and heat exchanger 30 acting as the condenser is directed by blower 38 into the opening 90. The portion of air entering opening 90 is directed through the chamber 66, across the surface of tray 68 containing the condensate, and to the low pressure area through the opening 98 where it is drawn into the blower 38 to be recirculated with the room air. The size and location of openings 90 and 98 are selected so that the flow of warm air passing therebetween is sufficient to maintain the temperature of area 66 and condensate water when present in tray 68 above freezing during the heating cycle of the unit.

Means are also provided to ensure that substantially all of relatively warm air directed by blower 38 into the opening 90 passes over the water in tray 68 and is not lost to ambient outdoor air surrounding chamber 66 while preventing substantial amounts of relatively colder outside air from entering chamber 66. To this end, the chamber 66 which in effect is defined by tray 68 may include insulating material 100 surrounding the tray 68 and extending between the bottom wall 18 of casing 12 and the bottom surface of base 23 of chassis 22. In the alternative, or also as shown, the height of the side walls 102 of tray 68 can be dimensioned to extend between the bottom wall of casing 12 and the bottom surface of base 23 of chassis 12. In either case, substantially all of the air entering opening 90 is confined to chamber 66 and passes over the water in tray 68.

The foregoing is a description of the preferred embodiment of the invention and variations may be made thereto without departing from the true spirit of the invention, as defined by the appended claims.

What is claimed is:

1. A self-contained air conditioning unit for heating and cooling an enclosure comprising:

a chassis including a base member and a barrier dividing said chassis into an inner compartment and an outer compartment;

inner and outer heat exchangers mounted respectively in said inner and outer compartments;

an inner air moving means for recirculating enclosure air through said inner compartment;

an outer air moving means for circulating air through said outer compartment;

a compressor;

means for selectively connecting said compressor to said heat exchangers whereby said outdoor heat exchanger functions as an evaporator during operation of the unit on the heating cycle and said indoor heat exchanger functions as an evaporator during the cooling cycle;

a condensate collection sump disposed in said base member being arranged to collect condensate from said outdoor heat exchanger during said heating cycle;

a drain opening in said sump;

a water collecting chamber arranged below said base member extending from a position below said drain opening for receiving water from said sump to a position underlying a portion of said inner compartment;

a first and second opening in said base member arranged over said portion of said water collecting chamber located below said inner compartment, said first opening being arranged relative to said inner air moving means so that a portion of the relatively warm air being recirculated by said inner air moving means is forced through said collecting chamber between said first and second openings and across the surface of said water when present.

condensate disposal means in said inner compartment being operable in the heating cycle including means extending into said collecting chamber for lifting and depositing said water when present into the path of air being circulated by said inner fan where it is vaporized and directed through the relatively warm inner heat exchanger.

2. The self-contained air conditioning unit recited in claim 1 wherein a drain control means associated with said drain includes a valve member operable relative to said drain for allowing water when present in said sump to flow into said water collecting chamber through said drain opening.

3. The self-contained air conditioning unit recited in claim 1 wherein said chassis is arranged in an outer casing and said water collecting chamber is defined by an area between said chassis base member and the bottom wall portion of said casing.

4. The self-contained air conditioning unit recited in claim 3 wherein the condensate from said drain is directed into a condensate collection tray in said collecting chamber positioned on the bottom wall portion of said casing.

5. The self-contained air conditioning unit recited in claim 4 wherein said condensate disposal means includes a housing mounted in said inner compartment adjacent said chassis base member, said housing having a wall member dividing said housing into a chamber and a passageway, a motor mounted in said chamber having its drive shaft extending into said passageway, a slinger disc on said shaft being arranged so that its lower edge extends through said second opening in said base member to a position in said collection chamber.

6. The self-contained air conditioning unit recited in claim 5 wherein said chassis is removably inserted into said casing through an opening at one end of said casing, said opening being defined by a frame edge formed around said opening, said slinger disc being formed of a resilient material that will allow the disc to flex when its lower edge extending through said second opening engages and passes over said frame edge to permit insertion of said chassis in said casing opening.

7. The self-contained air conditioning unit recited in claim 5 wherein a drain control means associated with said drain includes a valve member operable relative to said drain for allowing water when present in said sump to flow into said water collection tray at a preselected temperature.

8. The self-contained air conditioning unit recited in claim 1 wherein said condensate disposal means includes a housing mounted in said inner compartment adjacent said chassis base member, said housing having a wall member dividing said housing into a chamber and a passageway, a motor mounted in said chamber having its drive shaft extending into said passageway, a slinger disc on said shaft being arranged so that its lower edge extends through said second opening in said base member to a position in said collection chamber.

9. A self-contained air conditioning unit for heating and cooling an enclosure comprising:

a casing mounted in an aperture in the wall of the enclosure to be conditioned;

a chassis arranged in said casing including a base member and a barrier dividing said chassis into an inner compartment and an outer compartment;

inner and outer heat exchangers mounted respectively in said inner and outer compartments;

an inner fan for recirculating enclosure air through said inner compartment;

an outer fan for circulating air through said outer compartment;

a compressor;

means for selectively connecting said compressor to said heat exchangers whereby said outdoor heat exchanger functions as an evaporator during operation of the unit in the heating cycle and said indoor heat exchanger functions as an evaporator during the cooling cycle;

a condensate collection sump disposed in said base member being arranged to collect condensate from said outdoor heat exchanger during said heating cycle;

a drain opening in said sump;

a drain control means associated with said drain includes a valve member operable relative to said drain for allowing water when present in said sump to flow into said water collecting chamber through said drain opening;

a water collecting chamber arranged between said chassis base member and said casing, a tray arranged in said chamber extending from a position below said drain opening for receiving water from said sump to a position underlying a portion of said inner compartment;

a first and second opening in said base member arranged over said portion of said water collecting chamber located below said inner compartment, said inlet opening being arranged relative to said inner fan so that a portion of the relatively warm air being recirculated by said inner fan is forced through said collecting chamber between said first and second openings and across the surface of said water when present.

condensate disposal means in said inner compartment being operable in the heating cycle including a housing mounted in said inner compartment adjacent said chassis base member, said housing having a wall member dividing said housing into a chamber and a passageway, a motor mounted in said chamber having its drive shaft extending into said passageway, a slinger disc on said shaft being arranged so that its lower edge extends through said second opening in said base member to a position in said collection chamber for lifting and depositing said water when present into the path of air being circulated by said inner fan where it is vaporized and directed through the relatively warm inner heat exchanger.

10. The self-contained air conditioning unit recited in claim 9 wherein said chassis is removably inserted into said casing through an opening at one end of said casing, said opening being defined by a frame edge formed around said opening, said slinger disc being formed of a resilient material that will allow the disc to flex when its lower edge extending through said second opening engages and passes over said frame edge to permit insertion of said chassis in said casing opening.

* * * * *